US005653044A

United States Patent [19]

Thom, Jr.

[11] Patent Number: 5,653,044

[45] Date of Patent: Aug. 5, 1997

[54] HORIZONTAL COOLER AND DRYER WITH SOLID PANS

[75] Inventor: Kelsey C. Thom, Jr., Cedar Falls, Iowa

[73] Assignee: California Pellet Mill Company, San Francisco, Calif.

[21] Appl. No.: 620,770

[22] Filed: Mar. 22, 1996

[51] Int. Cl.[6] ..... F26B 19/00

[52] U.S. Cl. ..... 34/217; 34/236; 34/238

[58] Field of Search ..... 34/62, 182, 188, 34/217, 227, 235, 236, 238; 198/952; 62/373, 378

[56] References Cited

U.S. PATENT DOCUMENTS

| | | | |
|---|---|---|---|
| 1,375,080 | 4/1921 | Chappell | 34/235 |
| 2,343,762 | 3/1944 | Franklin | 198/229 |
| 2,500,352 | 3/1950 | Fulton | 34/236 |
| 3,525,167 | 8/1970 | French et al. | 198/144 |
| 3,793,745 | 2/1974 | Myers | 34/236 X |
| 3,811,557 | 5/1974 | Hartwig | 198/952 X |
| 3,863,755 | 2/1975 | Haertwig | 198/952 X |
| 3,900,958 | 8/1975 | Bongert et al. | 34/164 |
| 4,194,300 | 3/1980 | Swanson et al. | 34/236 X |
| 4,230,222 | 10/1980 | Clark | 198/580 |
| 4,991,315 | 2/1991 | Falck | 34/217 |
| 5,375,342 | 12/1994 | Giesler | 34/168 |

OTHER PUBLICATIONS

Drawing of a Solid Pan Cooler Sold by California Pellet Mill Company at Least as Early as 1988.

*Primary Examiner*—John M. Sollecito
*Assistant Examiner*—Steve Gravini
*Attorney, Agent, or Firm*—Nixon & Vanderhye

[57] ABSTRACT

A horizontal cooler/dryer having a continuous traveling conveyor, the conveyor being a chain conveyor formed of a plurality of links adjoined in end-to-end relationship, each of the links being pivotally pinned at its ends to adjacent links; a housing about the conveyor, the housing having a cooling gas inlet, a gas exhaust, a product inlet through which material to be cooled may be deposited on the conveyor and a product outlet through which cooled material can be discharged; and a plurality of non-perforate material pans mounted to the conveyor in juxtaposed overlapping relationship to form a substantially continuous surface about the conveyor.

11 Claims, 7 Drawing Sheets

HORIZONTAL COOLER AND DRYER WITH SOLID PANS

BACKGROUND OF THE INVENTION

This invention relates generally to coolers and dryers for agricultural products such as pellets, collets, flakes, meal and expandate products and more particularly to horizontal coolers and dryers with solid pans.

Solid or perforated pan conveyors of existing horizontal cooler/dryers have failed due to the bulk density (weight per cubic foot) of some of these products. These products also generate fines (dust) from normal handling in chutes, bins, conveyors, elevators, etc. Existing solid or perforated pan conveyors have difficulty with fines build-up in the pan louvers or perforations. Pans need to be cleaned routinely to maintain air flow and/or prevent pan damage. Fines leakage into the area between the conveyors can also occur, resulting in high maintenance. If maintenance is not performed as a routine, fines will build up between the conveyors and begin distorting the pans until they reach failure. Performance of internal screws and fines carriers of existing cooler/dryer conveyor designs have not been adequate for handling the large amount of fines found in some products.

Another problem which occurs in existing cooler/dryers is even cooling and/or drying of the product across the conveyor bed. Various plow and gate designs have been used in existing cooler/dryers to spread the product across the conveyor bed. These designs have difficulty controlling bed level resulting in choking or backup of some products. These designs have also damaged some products such as pellets and flakes by crushing (creating more fines).

A further problem in existing cooler/dryers is adequate air seals at the product inlet are difficult to achieve due to the product feeding and leveling mechanism occupying that area. Product inlets require sealing to restrict air flow into the cooler/dryer and fan duct. Some products such as pellets have fat (oil) added before cooling. Oil saturated air will coat the inlet plenum and fan duct resulting in fines build-up. Existing product inlet air seals can cause choking or backup of some products.

The foregoing illustrates limitations known to exist in present horizontal cooler/dryers. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a horizontal cooler/dryer comprising: a continuous traveling conveyor, the conveyor comprising a chain conveyor formed of a plurality of links adjoined in end-to-end relationship, each of the links being pivotally pinned at its ends to links adjacent thereto; a housing about the conveyor, the housing having a cooling gas inlet, a gas exhaust, a product inlet through which material to be cooled may be deposited on the conveyor and a product outlet through which cooled material can be discharged; and a plurality of non-perforate material pans mounted to the conveyor in juxtaposed overlapping relationship to form a substantially continuous surface about the conveyor, each of the material pans comprising an elongated plate having a material holding receiver with an open top.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
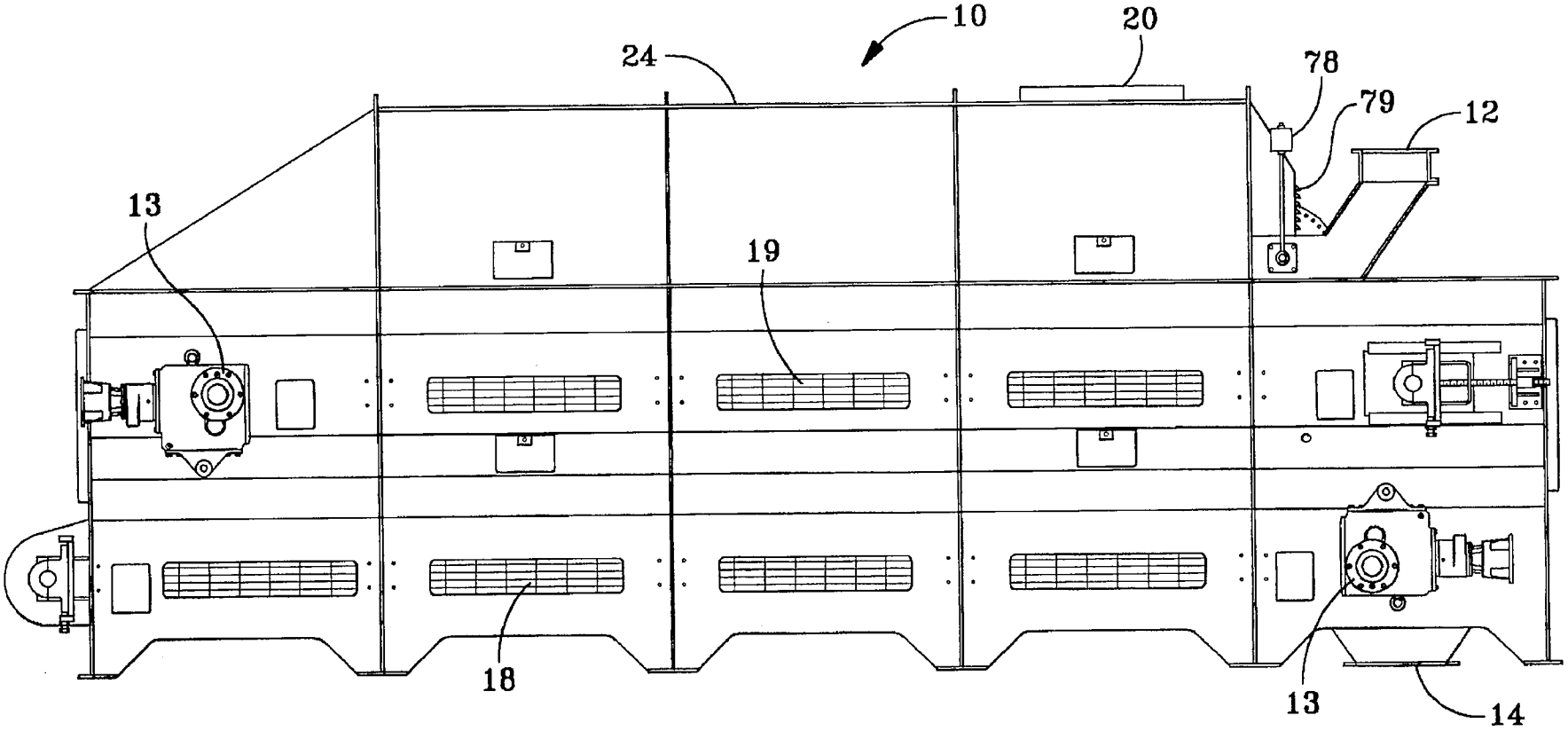
FIG. 1 is a side view of a cooler/dryer in accordance with the present invention.
Figure 2:
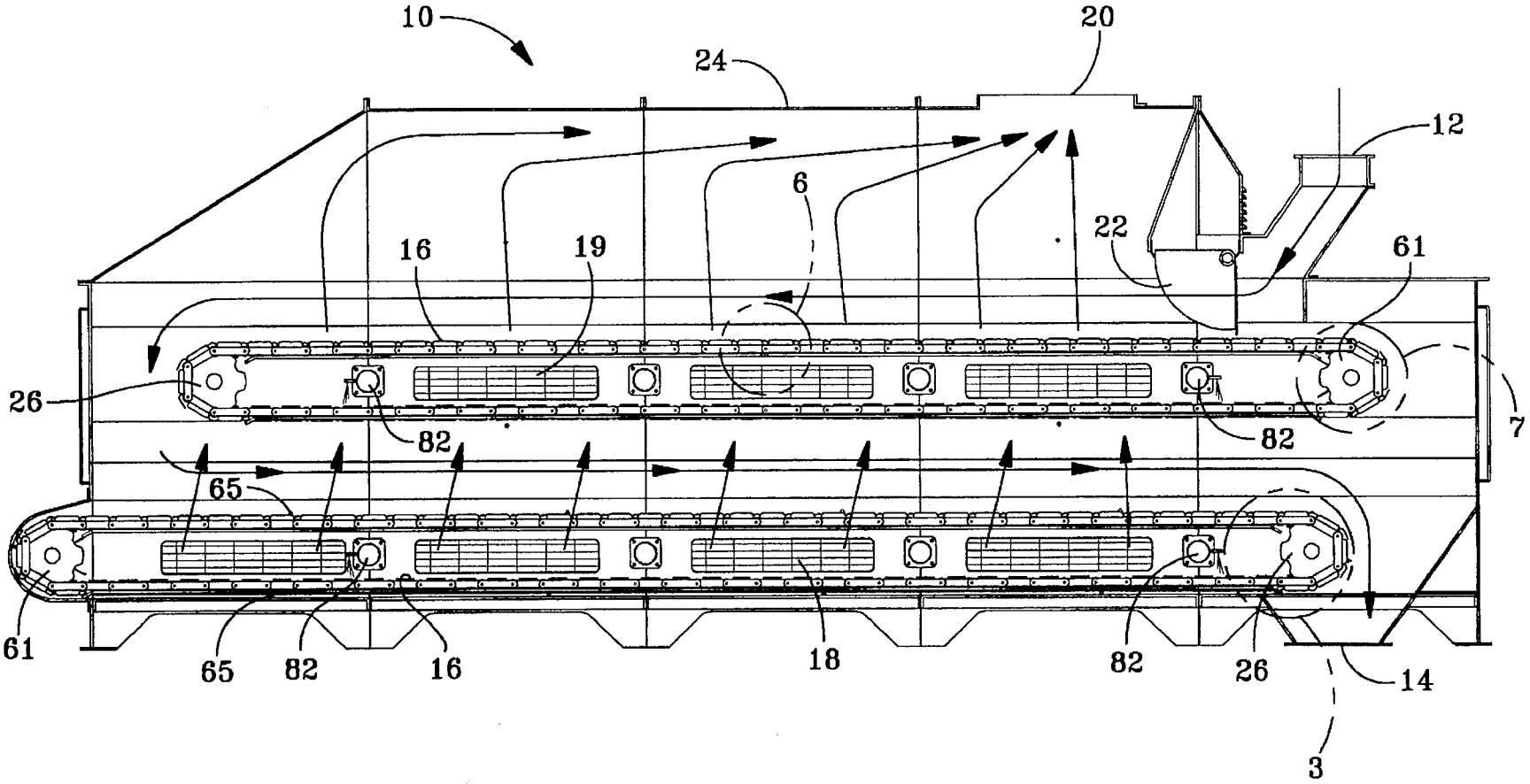
FIG. 2 is a side interior view of the cooler/dryer shown in FIG. 1.
Figure 3:
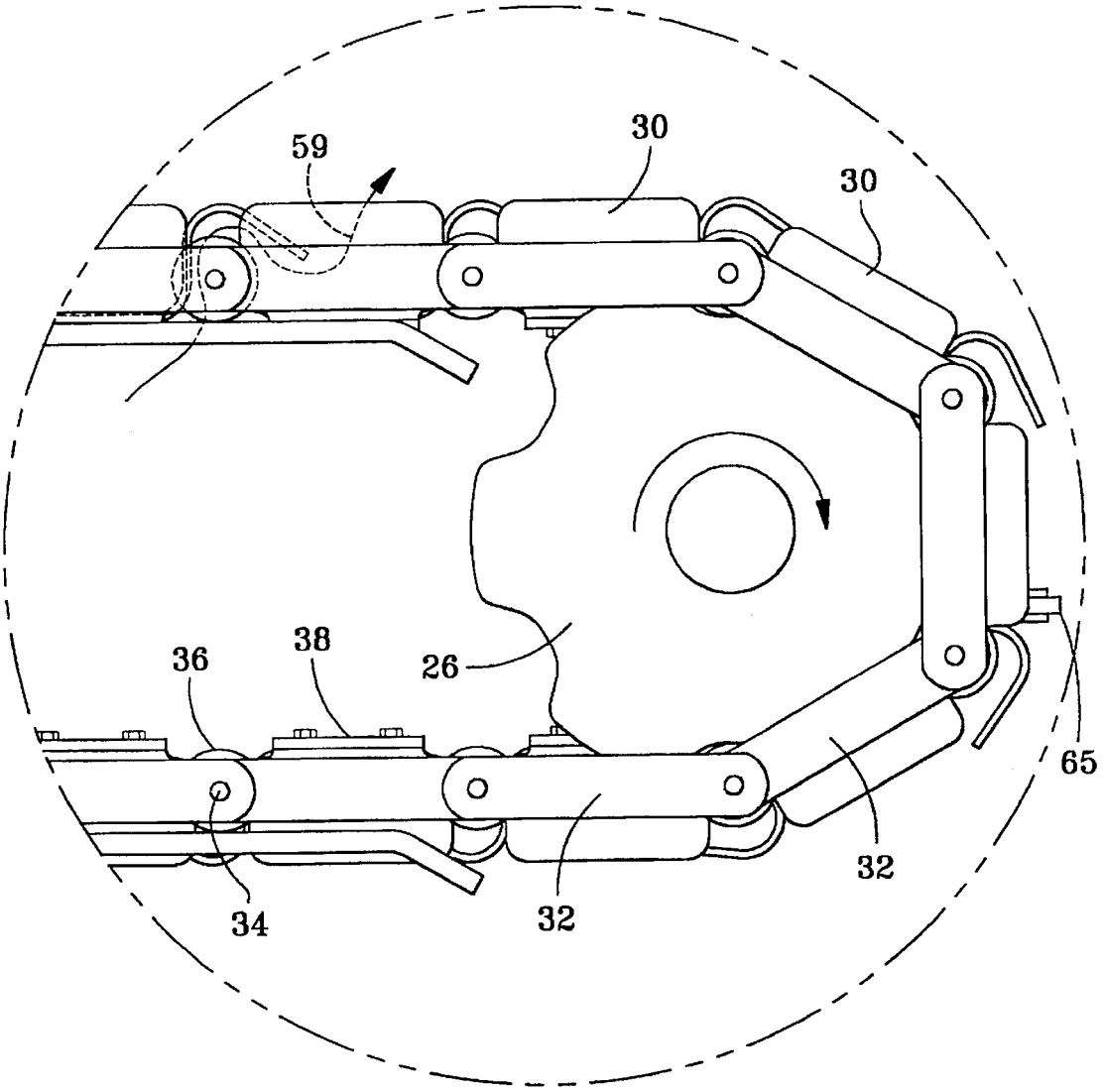
FIG. 3 is a partial enlarged view of the details of the solid pans shown in FIG. 2.
Figures 4, 5:
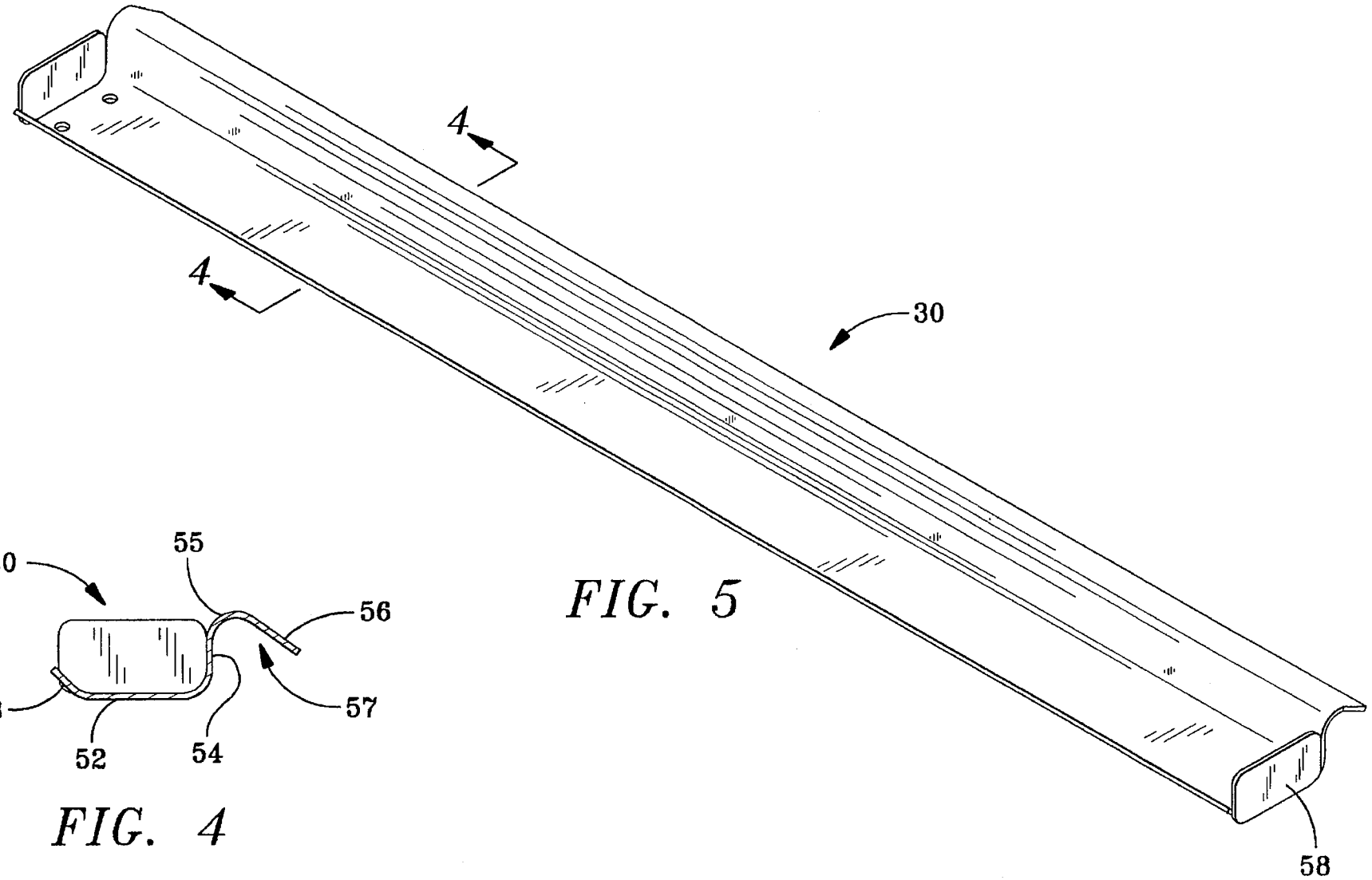
FIG. 4 is a cross-sectional view of a solid pan.
FIG. 5 is a perspective view of one solid pan.

FIGS. 1 and 2 show a horizontal cooler/dryer 10 which is used to transport agricultural material (product) such as pellets, collets, flakes, meal and expandate products through a cooling (and optionally a drying zone) to bring the material into contact with cooling and/or drying air. The cooler/dryer 10 uses solid material pans 30 with special formed shapes to resist build-up of fines which are mounted to a roller chain conveyor 16 creating large louver type air passages 59 between the pans. The solid material pan 30 is shaped to avoid sharp corners which can accumulate fines. The shape of this pan 30 is stronger than prior art pans due to its vertical depth. The stronger pans have greater resistance to distortion from product weight and/or fines build-up. The material in the pans 30 is normally stainless steel. However, other metals or materials can be used to suit the product being cooled or dried. Rubber pan seals 63 mounted on the sprocket 61 shafts are used in conjunction with the pan pocket 57 to trap fines (dust) and return the fines to the material being cooled. Air nozzles 82 mounted in the cooler/dryer housing are used to purge fines from the material pans 30 at timed intervals.

The product bed is leveled by dragging the lower edge 77 of a hollow pivoting quarter drum 22 across the product. The leveling is produced by the weight of the quarter drum 22 pivoting down against the product. Counter weights 78 can be used to control the leveling pressure against the product to avoid crushing or other product damage. Negative air pressure maintained in the cooler/dryer housing by an exhaust fan (not shown) does not cause the pivoting quarter drum to open which then restricts air flow from the product inlet. Bed depth is controlled by the speed of the cooler/dryer conveyor 16 and/or the speed of the product feeder (not shown).

The horizontal cooler/dryer 10 includes a product inlet 12 in the top of the housing 24 and a product outlet 14 in the bottom of the housing 24. Located within the housing 24 are two parallel conveyors 16, one located over the other. Although two conveyors 16 are shown, a single conveyor can be used. In this instance, the product outlet 14 would be located at the end opposite the end with the product inlet 12. With a double pass conveyor, as shown in FIG. 2, the product is dropped from the upper conveyor 16 to the lower conveyor 16. Preferably, each conveyor 16 is provided with a separate drive motor 13. Located along the sides of the housing 24 are a plurality of cool air inlets 18. An exhaust 20 is provided in the top of the housing 24. An exhaust fan (not shown) is used to pull the cooling air through the housing 24, thereby causing a negative pressure within the housing 24.

Additional cooling air or heated drying air can optionally be provided through a plurality of hot air inlets 19 also located in the sides of the housing 24.

The conveyor 16 is a continuous chain conveyor formed of a plurality of laterally extending links 32 connected to adjacent links 32 by a link pin 34. Usually, two parallel links 32 separated by rollers 36 are used for each link of the conveyor 16. One of the two parallel links has a horizontally extending portion (link extension) 38 to which a transversely extending solid material pan 30 is attached. One continuous chain conveyor is provided for each end of the solid material pans 30. Preferably, the bottom of the solid material pans 30 are offset below the connecting pins 34. As shown in FIG. 2, the conveyor passes about sprockets 26 and 61.

Figure 6:
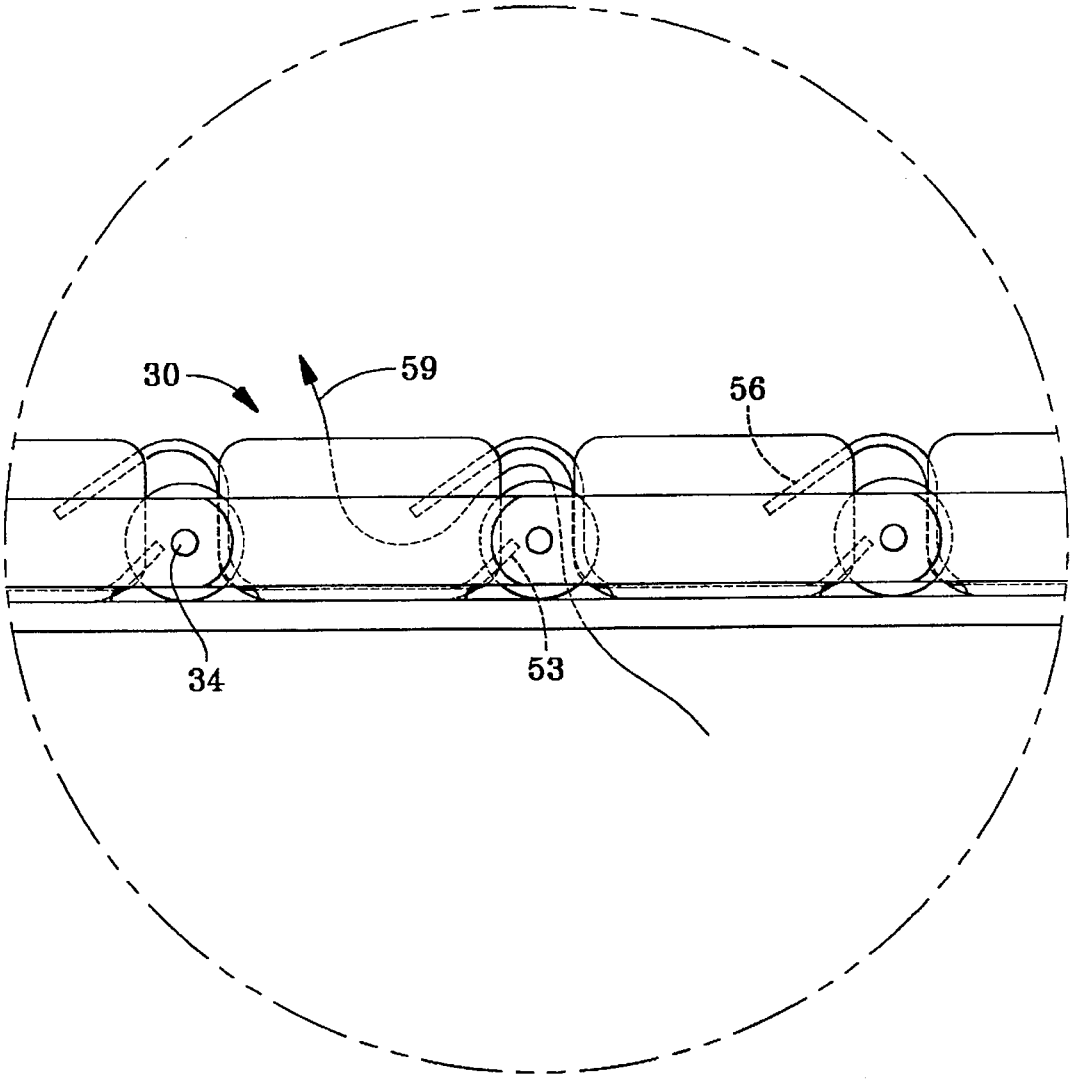
FIG. 6 is a partial enlarged view showing the overlapping arrangement of several solid pans.

FIGS. 3 through 6 show the details of the overlapping solid material pans 30. Each pan is formed of a transversely extending plate having a middle flat portion 52 connecting a first laterally extending substantially straight portion 53 and a second laterally extending portion. The second laterally extending portion consists of a first straight side portion 54 connected by an arcuate curved portion 55 to a second straight angle portion 56. The underside of the second laterally extending portion defines a fines trapping pocket 57. Preferably, the second laterally extending portion is connected to the middle flat portion 52 by a radius and the first straight side portion 54 is at a right angle to the middle flat portion 52. Also, preferably, the first laterally extending portion 53 and the second straight angle portion 56 are substantially parallel. The lengths of the first laterally extending portion 53 and the second straight angle portion 56 are selected such that the two portions 53, 56 from adjacent solid material pans 30 overlap as shown in FIG. 6. The overlap of the first laterally extending portion 53 and the second straight angle portion 56 from adjacent solid material pans 30 define an air passage or louver 59 through which cooling and/or drying air passes into and through the product in the solid material pan 30. The free end of the first laterally extending portion 53 terminates near the connecting pin 34. The combination of the overlapping portions, the free end of the first laterally extending portion terminating near the connecting pin 34, and the bottom of the solid material pan 30 being located below the plane of the connecting pins 34 function together to prevent the gap or air passages 59 between adjacent solid material pans 30 from opening up as the solid material pans 30 pass around the sprockets 26, 61. In particular, by locating the free end of the first laterally extending straight portion 53 near the connecting pin 34, the air passage 59 is kept small enough to prevent product from entering the air passage 59. For the design shown in the FIGURES, the air passage 59 actually closes up as the solid material pans 30 pass around the sprockets. Side panels 58 or ends are provided on each end of the solid material pans 30.

Figure 7:
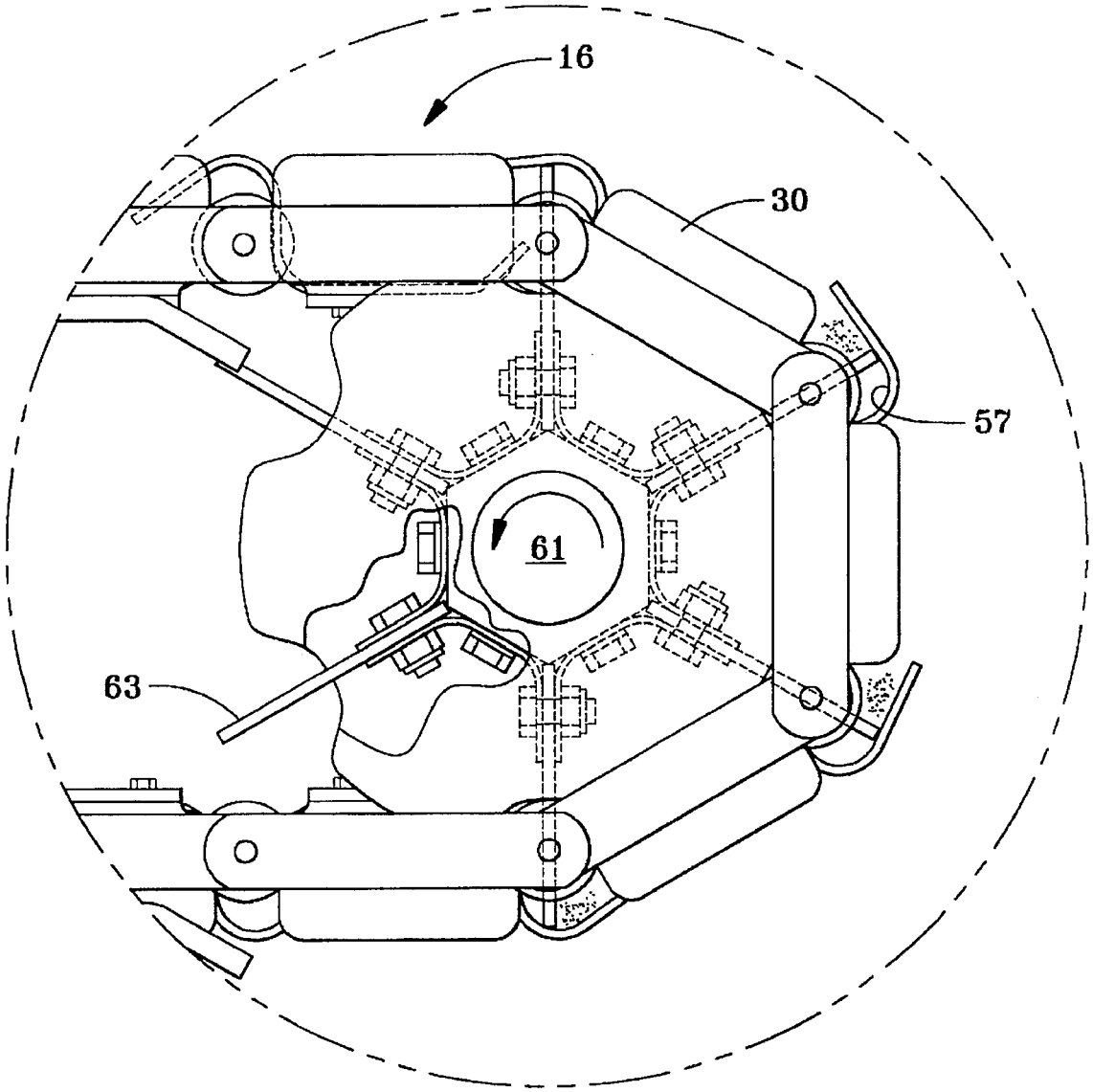
FIG. 7 is a second partial enlarged view of the solid pans shown in FIG. 2, showing the details of the pan seal.
Figure 8:
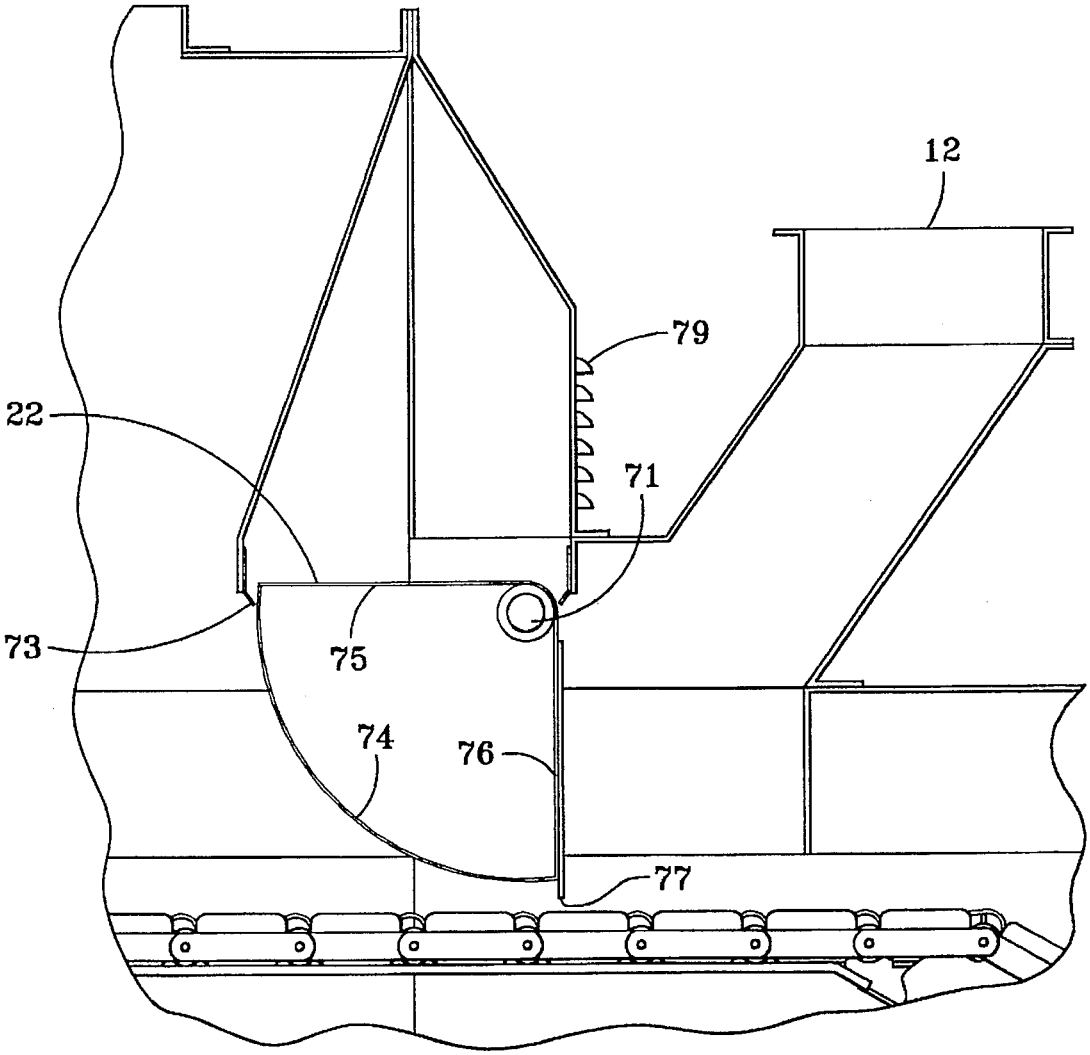
FIG. 8 is a partial enlarged view showing the details of the quarter drum air seal and bed leveler shown in FIG. 2.

A plurality of transversely extending pan seals 63 formed of a flexible material such as urethane are attached to the sprocket 61 shaft, as shown in FIG. 7. The pan seals 63 are positioned such that as the sprocket 61 rotates (by movement of the conveyor 16), a pan seal 63 fits into the pocket 57 of the solid material pan 30 entering the bottom of the sprocket 61 and traps any fines in the pocket 57. The fines are trapped ahead of the pan seal 63. As a result, as the solid material pan 30 rotates around the sprocket 61 and becomes right side up (which makes the pocket 57 upside down) the fines drop out of the pocket 57 and into the adjacent leading solid material pan 30.

A plurality of air nozzles 82 are provided to blow accumulated fines off of the backside of the solid material pans 30 and the conveyor 16. Each air nozzle 82 consists of a horizontally extending conduit having a downward directing aperture through which air is blasted in a downward direction to blow fines off the conveyor 16 and solid material pans 30. Generally, an air blast is used only periodically for short periods of time.

A plurality of laterally spaced flexible sweepers 65 are attached to the lower conveyor 16. The flexible sweepers 65 extend transversely from one side of the conveyor 16 to the other side of the conveyor 16. As the conveyor travels about the sprockets 26, 61, the flexible sweepers 65 drag across the floor of the housing 24 and drag any fines along the floor, up and around the housing enclosing the non-driven sprocket 26 and then drop the fines into the solid material pans 30.

A hollow pivoting quarter drum 22 is provided in the housing 24 adjacent the product inlet 12 to prevent outside air from entering the negative pressure area in the housing through the product inlet 12. The quarter drum shape causes the force of the negative air pressure to act (or focus on) the pivot point 71 of the quarter drum 22. This reduces the tendency of the negative internal air pressure to open the pivoting quarter drum air seal 22. The hollow quarter drum 22 is formed of three sides, a 90 degree arc curved side 74 connected to two straight sides 75, 76. A wear plate with a lower leveling edge 77 can be attached to the drum 22. An extension 73 of housing 24 terminates near the curved surface 74 to provide an air seal. Since a small air gap is preferred (to prevent the extension from engaging the pivoting quarter drum 22), a small, but controlled, amount of air enters the housing 24. Because the quarter drum 22 pivots about pivot 71 in response to changes to the product feed rate, louvers 79 can be provided in the housing 24 to allow air to flow into and out of the enclosed area over the drum 22. A counterweight 78 is attached to the drum 22 to balance the weight of the drum 22 to reduce the tendency of the drum to damage or crush the product passing beneath the drum 22. In addition to sealing the product inlet 12 from the negative air pressure in the housing 24, the pivoting quarter drum 22 also levels the product entering the solid material pans 30.

Having described the invention, what is claimed is:

1. A horizontal cooler/dryer comprising:

a continuous traveling conveyor, the conveyor comprising a chain conveyor formed of a plurality of links adjoined in end-to-end relationship, each of the links being pivotally pinned at its ends to links adjacent thereto;

a housing about the conveyor, the housing having a cooling gas inlet, a gas exhaust, a product inlet through which material to be cooled may be deposited on the conveyor and a product outlet through which cooled material can be discharged; and a plurality of non-perforate material pans mounted to the conveyor in juxtaposed overlapping relationship to form a substantially continuous surface about the conveyor, each of the material pans comprising an elongated plate having a material holding receiver with an open top, the material pan being connected to a link such that at least a portion of the elongated plate is in a plane offset from a first plane which passes through the pivotally pinned connections of the link, said at least a portion of the elongated plate being offset on one side of the first plane and other portions of the elongated plate and the open top being offset on the other side of the first plane.

2. A horizontal cooler/dryer comprising:

a continuous traveling conveyor;

a housing about the conveyor, the housing having a cooling gas inlet, a gas exhaust, a product inlet through which material to be cooled may be deposited on the conveyor and a product outlet through which cooled material can be discharged; and a plurality of non-perforate material pans mounted to the conveyor in juxtaposed overlapping relationship to form a substantially continuous surface about the conveyor, each of the material pans comprising an elongated plate having a middle flat portion connecting a first laterally extending substantially straight portion to a second laterally extending portion, the first straight portion being at an angle to the middle flat portion, the second portion having a first straight side portion and a second straight angle portion connected by an arcuate curved portion, the first straight side portion being connected to the middle flat portion, the concave side of the arcuate curved portion and the second straight angle portion defining a pocket.

3. The horizontal cooler/dryer according to claim 2, wherein the second straight angle portion of one juxtaposed material pan overlaps the first laterally extending substantially straight portion of an adjacent juxtaposed material pan thereby defining a an air passageway therebetween.

4. The horizontal cooler/dryer according to claim 3, wherein the first laterally extending substantially straight portion of the material pan is substantially parallel to the second straight angle portion of the material pan.

5. The horizontal cooler/dryer according to claim 2, wherein the conveyor comprises a chain conveyor formed of a plurality of links adjoined in end-to-end relationship, each of the links being pivotally pinned at its ends to links adjacent thereto; and the middle flat portion of a material pan being connected to a link such that the middle flat portion is in a plane offset from a plane which passes through the pivotally pinned connections of the link.

6. The horizontal cooler/dryer according to claim 5, wherein the free end of the first laterally extending substantially straight portion terminates proximate a link pivotally pinned connection.

7. The horizontal cooler/dryer according to claim 2, wherein the first straight side portion is substantially 90 degrees to the middle flat portion.

8. The horizontal cooler/dryer according to claim 2, wherein the first straight side portion is connected to the middle flat portion by an arcuate portion.

9. The horizontal cooler/dryer according to claim 2, further comprising a pair of spaced apart shaft mounted sprockets about which the conveyor is wrapped, one of said sprocket shafts having a plurality of flexible pan seal means extending outwardly thereof into the pocket of a material pan, for holding any fines material, which may have been formed from said material, in the pocket as the material pan passes around the sprocket.

10. A horizontal cooler/dryer comprising:

a continuous traveling conveyor, the conveyor comprising a chain conveyor formed of a plurality of links adjoined in end-to-end relationship, each of the links being pivotally pinned at its ends to links adjacent thereto;

a housing about the conveyor, the housing having a cooling gas inlet, a gas exhaust, a product inlet through which material to be cooled may be deposited on the conveyor and a product outlet through which cooled material can be discharged; and a plurality of non-perforate material pans mounted to the conveyor in juxtaposed overlapping relationship to form a substantially continuous surface about the conveyor, each of the material pans comprising an elongated plate having a middle flat portion connecting a first laterally extending substantially straight portion to a second laterally extending portion, the first straight portion being at an angle to the middle flat portion, the second portion having a first straight side portion and a second straight angle portion connected by an arcuate curved portion, the first straight side portion being connected to the middle flat portion, the concave side of the arcuate curved portion and the second straight angle portion defining a pocket, the second straight angle portion of one juxtaposed material pan overlapping the first laterally extending substantially straight portion of an adjacent juxtaposed material pan thereby defining a cooling gas passageway therebetween, the middle flat portion of a material pan being connected to a link such that the middle flat portion is in a plane offset from a plane which passes through the pivotally pinned connections of the link.

11. A horizontal cooler/dryer comprising:

a continuous traveling conveyor;

a housing about the conveyor, the housing having a cooling gas inlet, a gas exhaust, a product inlet through which material to be cooled may be deposited on the conveyor and a product outlet through which cooled material can be discharged; and a plurality of non-perforate material pans mounted to the conveyor in juxtaposed overlapping relationship to form a substantially continuous surface about the conveyor, each of the material pans comprising an elongated plate having at least one transversely extending arcuate shaped portion defining a pocket; and a pair of spaced apart shaft mounted sprockets about which the conveyor is wrapped, one of said sprocket shafts having a plurality of flexible pan seal means extending outwardly thereof into the pocket of a material pan, for holding any fines material which may be formed from said material in the pocket as the material pan passes around the sprocket.

* * * * *